US005152432A

United States Patent [19]

De Laforcade

[11] Patent Number: 5,152,432

[45] Date of Patent: Oct. 6, 1992

[54] DISPENSING DEVICE COMPRISING AT LEAST ONE BOTTLE WITH A FRANGIBLE END FITTING

[75] Inventor: Vincent De Laforcade, Clamart, France

[73] Assignee: L'Oreal, Paris, France

[21] Appl. No.: 588,975

[22] Filed: Sep. 27, 1990

[30] Foreign Application Priority Data

Oct. 4, 1989 [FR] France ..... 89 12970

[51] Int. Cl.[5] ..... B67D 5/60; B65D 47/10

[52] U.S. Cl. ..... 222/145; 222/212; 222/541

[58] Field of Search ..... 222/94, 212, 215, 145, 222/129, 541, 548

[56] References Cited

U.S. PATENT DOCUMENTS

| | | | |
|---|---|---|---|
| 3,263,874 | 8/1966 | Porter et al. | 222/541 X |
| 3,369,707 | 2/1968 | Porter et al. | 222/541 X |
| 3,866,800 | 2/1975 | Schmitt | 222/94 |
| 4,771,919 | 9/1988 | Ernst | 222/94 X |
| 4,838,457 | 6/1989 | Swahl et al. | 222/94 X |
| 4,871,090 | 10/1989 | Hoffmann | 222/145 X |
| 4,893,729 | 1/1990 | Iggulden et al. | 222/145 X |

FOREIGN PATENT DOCUMENTS

| | | | |
|---|---|---|---|
| 539551 | 6/1971 | Switzerland . | |
| 1103534 | 2/1968 | United Kingdom | 222/94 |

*Primary Examiner*—Kevin P. Shaver

*Attorney, Agent, or Firm*—Cushman, Darby & Cushman

[57] ABSTRACT

A dispensing device includes at least one bottle provided at its end remote from its bottom with a dispensing opening closed by a frangible end fitting and it also includes a cap fitted on the bottle on the side of adjacent said dispensing opening. The cap includes at least one shoulder intended to entrain said frangible end fitting as the cap is displaced, so as to release the dispensing opening. The cap also includes a discharge passageway issuing outside the device and communicating with the dispensing opening of the bottle in a position of the cap where the frangible end fitting is released from the dispensing opening.

7 Claims, 4 Drawing Sheets

DISPENSING DEVICE COMPRISING AT LEAST ONE BOTTLE WITH A FRANGIBLE END FITTING

FIELD OF THE INVENTION

The present invention relates to a dispensing device comprising at least one bottle with a frangible end fitting.

PRIOR ART

Bottles with frangible end fittings are already known and have the well known advantage that they have seals that are hermetically very reliable until opened by the user. A conventional type of such frangible end fittings is a glass ampoule used, for example, in the medical field or in the cosmetics field, most frequently with liquid contents, flame-sealed at one of their ends.

However, such bottles are generally difficult or inconvenient to open. Indeed, to obtain this opening, a user must break the frangible end fitting of the bottle by gripping it between the thumb and index finger and by exerting a shear stress on it. Frequently, the user's fingers sustain slight local injuries, in particular at the points of contact of the fingers with the end fitting which has been broken, on which contact points the force was exerted.

To remedy this drawback, it has moreover been proposed to use bottles comprising caps made of a plastic material which are extended as dispensing tubes whose openings are hermetically sealed by end fittings integrally moulded with these caps. To open such a bottle, a user has to cut the end fitting by means of a knife or scissors. Now this is not convenient since it requires the use of extraneous tools.

OBJECTS OF THE INVENTION

It is an object of the present invention to provide a dispensing device, in particular for liquid or viscous products, comprising at least one bottle associated with a cap mounted on the bottle and movable in relation thereto, the cap being provided with at least one shoulder capable of coming to bear during displacement of the cap, on the frangible end fitting associated with the bottle.

It is a further object to provide such a device which has in particular the advantage, as compared with bottles with already known frangible end fittings, that it allows a user to spread the force he exerts for breaking the end fitting over the whole of his hand and thus to avoid localized forces on the fingers.

It is a still further object of the present invention to provide dispensing devices comprising several separate bottles joined to each other, and whose dispensing openings are interconnected by the same dispensing head to a single ejection duct, whence there emerges a mixture of different products each one contained in a respective one of these bottles. A device of this kind has been described in French Patent Application No. FR-89 06540, filed by the Assignees hereof, and it has the advantage that it allows the storing of two incompatible products (for example, hydrogen peroxide and a reducing agent) in two receptacles made of different materials, each compatible with the respective product contained therein. So far, the bottles of these devices comprised, as explained above, caps ending in dispensing tubes closed by end fittings integrally moulded with the caps. This obliged the user, before being able to use such a device, to perform many inconvenient manipulations since it was at first necessary to disengage the dispensing head from the tube of each bottle, then to cut the end fittings of the bottle by means of scissors or knives and finally to reposition the dispensing head on the bottle. It is therefore a further object of the present invention to provide a much simpler and more convenient opening system and that is perfectly suited to such devices with multiple bottles.

SUMMARY OF THE INVENTION

Accordingly the present invention provides a dispensing device comprising at least one bottle delimited by a bottom and a side, said bottle being provided, at its end on the side remote from its bottom, with a dispensing opening closed by a frangible end fitting; characterized in that it comprises a cap fitted on said bottle on the side adjacent said dispensing opening, said cap being movable relative to said bottle and comprising at least one shoulder intended to entrain said frangible end fitting as the cap is displaced so as to release the dispensing opening, said cap also comprising a discharge passageway issuing outside the device and communicating with the dispensing opening of said bottle in a position of the cap where said frangible end fitting is released from said dispensing opening.

Advantageously, the cap is movable in rotation in relation to the bottle whereon it is fitted, the dispensing opening of the bottle and the frangible end fitting associated therewith being placed in an eccentric position relative to the axis of rotation of the cap; this device comprises a supporting wall, on one surface of which there is a frangible end fitting caused to slide by the shoulder of the associated cap, said surface being disposed near the dispensing opening associated with the frangible end fitting substantially in the same plane as the latter.

Preferably, a shoulder of the cap is a side of a bushing, the bushing extending inside the cap and substantially surrounding the frangible end fitting associated therewith. The internal surface of the bushing may substantially conform to the external shape of the associated frangible end fitting. The bushing can have an oblong internal cross section, and be capable of sliding relative to the associated frangible end fitting.

Again preferably, a bottle comprises a neck cooperating with a sub-cap extending in an outlet tube closed by a frangible end fitting; the discharge passageway of the dispensing cap comprises a chamber wherein there issues the dispensing opening of the bottle in a position of the cap where the frangible end fitting associated with the dispensing opening is released from the latter, the chamber being extended in an ejection duct issuing outside the cap.

In an advantageous embodiment, the device comprises several bottles joined to each other and whose dispensing openings are all closed by frangible end fittings. The bottles may each comprise a side having a flexible portion and being deformed under the user's manual action. The device may comprise a cap wherein the bottles are fitted towards their end remote from their bottom, the bottom of the cap serving as a supporting side and being traversed by cut outs wherein the ends of the outlet tubes of the bottles are accommodated. Several bottles may be associated with the same cap movable in rotation relative to the bottles, the dispensing openings of the said bottles and the associated frangible end fittings being placed in an eccentric position in relation to the axis of rotation of the said cap. The cap may comprise a wall having an outer shape of revolution wherewith the cap cooperates so as to be guided in its rotational motion.

Preferably, the device comprises a mixing chamber into which the dispensing openings of the bottles issue, the mixing chamber being extended on the side remote from the openings by an ejection duct; it comprises two bottles, whose two frangible end fittings closing the dispensing openings are associated, one with a bushing substantially conforming to the outer shape of the end fitting, and the other with a bushing having an oblong cross section; some bottles are joined by means of press studs; some bottles are joined to each other near their bottom; the device comprises an outer cap fitted on the bottles near their bottom.

BRIEF DESCRIPTION OF THE INVENTION

To render the present invention more readily understood several embodiments thereof, represented in the attached drawings, will be described below on a purely illustrative but non-restrictive basis.

DETAILED DESCRIPTION OF THE PREFERRED EMBODIMENT

Figure 1:
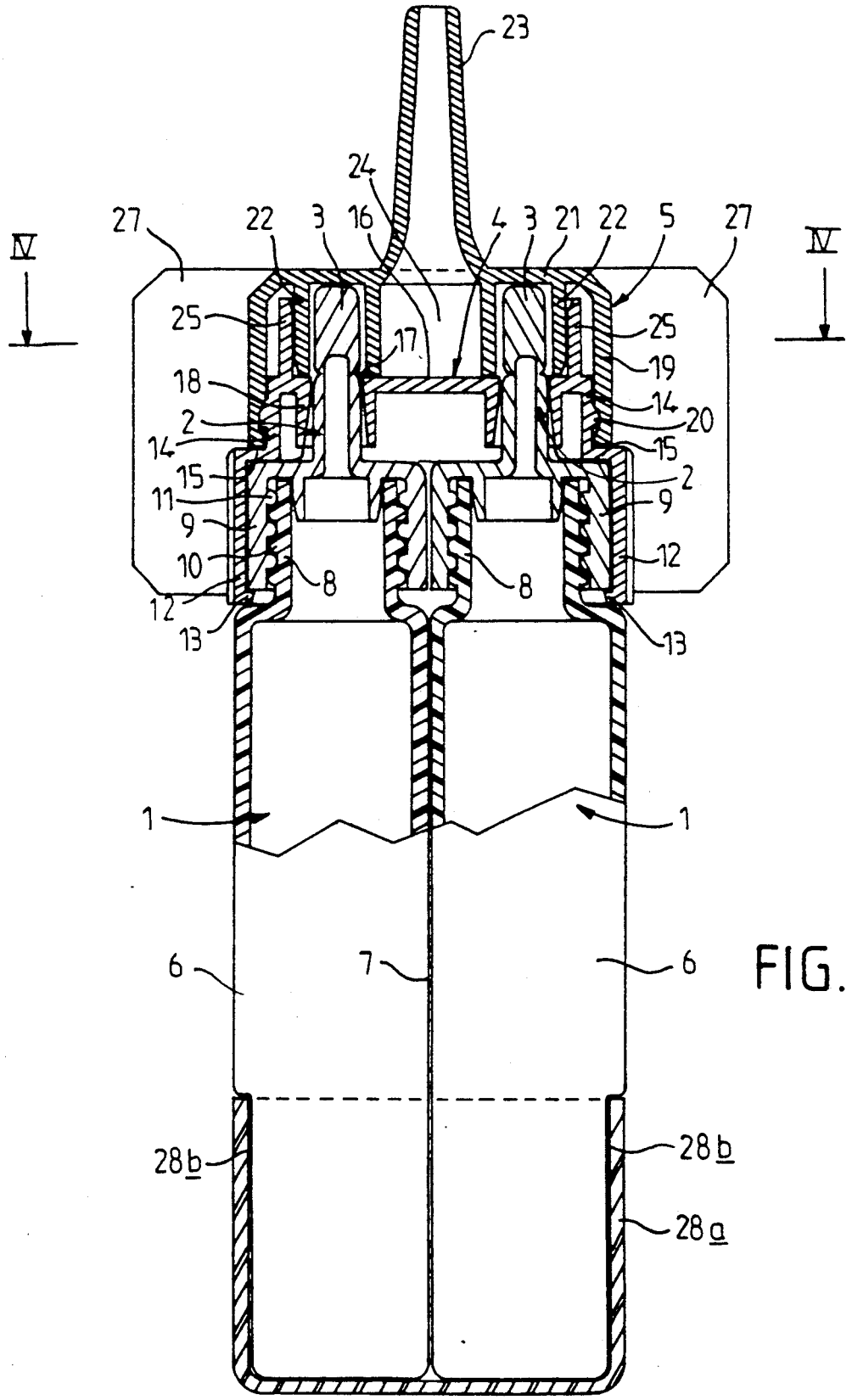
FIG. 1 is a partly sectioned elevation taken along section line I—I of FIG. 4, of a dispensing device in accordance with a first embodiment of the invention represented in its closed position, this device corresponding to a first variant for the fixing of the container parts of the bottles.
Figure 3:
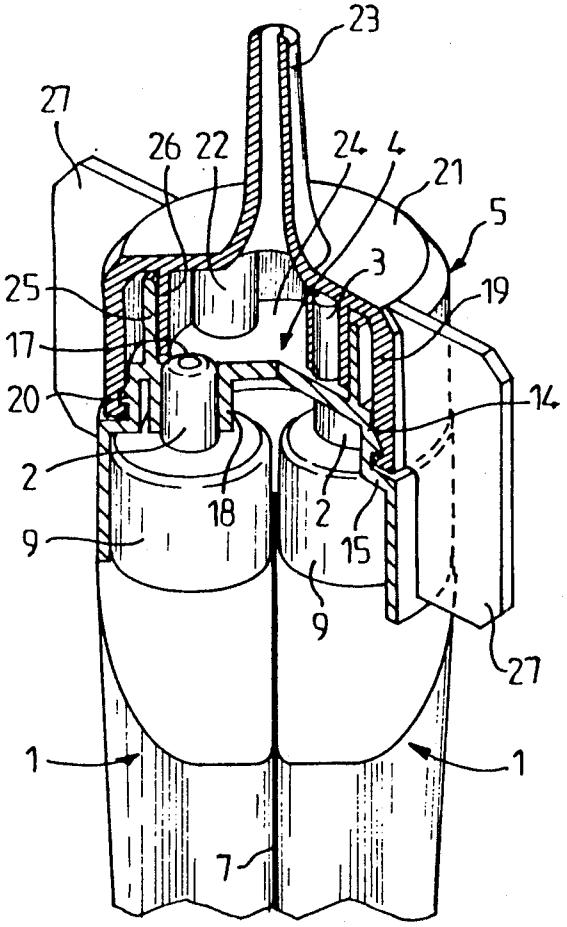
FIG. 3 is a partly sectioned perspective view similar to FIG. 2, but showing the dispensing device of FIG. 1 in an open position.
Figure 2:
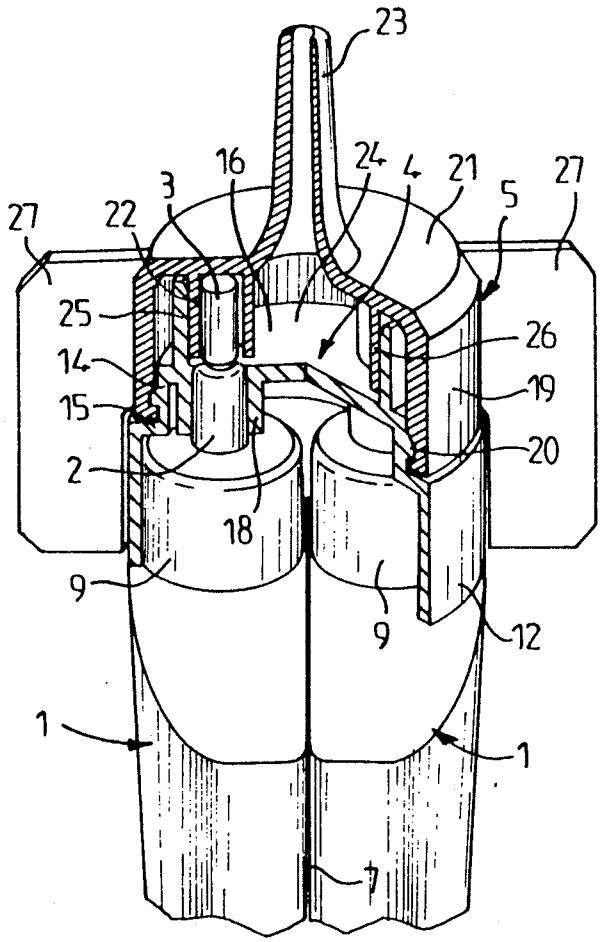
FIG. 2 is a partly sectioned perspective view of the dispensing device of FIG. 1.

In FIGS. 1 to 5 it will be seen that a dispensing device in accordance with a first embodiment of the invention, comprises in essence two bottles 1 in combination, joined to each other and each ending in a dispensing tube 2 and having their frangible end fittings 3 traversing the same connector cap 4, itself surmounted by a dispensing cap 5.

Each bottle 1 comprises in essence a container part 6 delimited by a bottom and sides and having one flat side 7, the two bottles 1 of the device being placed side by side against each other in the region of their flat side 7. Each container 6 terminates on the opposite side to its bottom in a cylindrical neck 8. The outer surface of this neck 8 cooperates with the inner surface of the sleeve of a sub-cap 9 mounted on the neck 8 and extended by the tube 2 of the bottle 1 to which there corresponds the neck 8, the tube 2 and the neck 8 being centred on the same axis. A neck 8 and the capsule associated therewith are joined to each other by means of threads 10 and 11 wherewith their contact surfaces are respectively provided. The two bottles 1 are moulded from plastic materials which may be different, the sub-caps 9 also being molded from plastic materials and forming a single part with the tube 2 and the frangible end fitting 3 wherewith they are associated. The sides of the containers 6 that are opposite the sides 7 comprise a flexible portion that can be deformed by an operator by manual pressure.

The outer wall of the connector cap 4 is a cylindrical skirt 12 whose axis is substantially the median line between the lines carried by the axes of the necks 8 of the two bottles 1. This skirt 12 is fitted on the sub-caps 9 to which its inner surface is locally tangential, the said skirt 12 terminating at its end nearer the bottom of the bottles 1 and towards its surface tangential to the sub-caps 9 in an inner flange 13 inserted between the sides of the containers 6 which bear the necks 8 and capsules 9 perpendicularly. At its other end, this skirt 12 is surmounted by a cylindrical wall 14 centred on the axis of the skirt and having a diameter smaller than that of the skirt. The wall 14 and the skirt 12 are interconnected by a set-back 15 perpendicular to their axis, this set-back 15 coming to bear partly on the flat sides of the sub-caps 9 that carry the tubes 2. This cylindrical wall 14 ends in a wall 16 that forms the bottom of the cap 4 and is perpendicular to its axis, the outer surface of this bottom 16 being situated substantially at the level of the dispensing openings of the tubes 2, on which openings frangible end fittings 3 are mounted. The tubes and their frangible end fittings 3 pass through the wall 16 at the level of the cut outs 17 arranged in the wall, each one of these cut outs 17 being annularly surrounded by a sleeve 18 which extends upwardly from the inner surface of the bottom 16 and has a respective tube 2 fitted in it.

The cap 5 comprises a cylindrical wall 19 fitted on the wall 14, the wall 19 having an internal diameter corresponding substantially to the external diameter of the wall 14. The wall 14 is provided externally with an annular protuberance 20 with which cooperates a complementary inner annular cut out of the wall 19, the cap 5 and the wall 19 being free to rotate in relation to the axis of the cap 4. This wall 19 ends, at its side remote from the free end of the cap 5, in a top 21 parallel to the bottom 16. This top 21 is provided on one of its diameters with two bushings 22 extending downwardly from the top 21 towards and wherein the frangible end fittings 3 are disposed, these bushings 22 having internal cylindrical shapes corresponding substantially to the outer shape of the end fittings 3. These two bushings 22 are interconnected by a cylindrical wall 26 of the same height as and being tangential to the bushings 22, the bushings 22 being disposed within the space delimited by this cylindrical wall 26. This wall 26 is intended to cooperate with a cylindrical wall 25 of the same height, extending from the bottom 16 of the cap 4 on the cap surface which is more remote from the sleeves 18, this wall 25 being centred on the axis of the skirt 12 and having an internal diameter corresponding substantially to the external diameter of the wall 26. The cap 5 is moreover extended beyond the top 21 in an ejection duct 23 delimited by a side having a frustoconical shape tapering from the top 21 up to one end where the said duct 23 issues, the duct 23 issuing at its other end in a chamber 24 delimited by the bottom 16 and top 21, as well as by the cylindrical wall 26. Finally, the cap 5 comprises two diametrically opposed fins 27, each fin 27 extending radially outwardly from the wall 19 and being substantially in the plane passing through the axes of the bushings 22.

The two bottles 1 are joined to each other, on the one hand, towards their dispensing ends by the cap 4 and, on the other hand, towards their bottom by means of an outer cap 28*a* fitted on a portion 28*b* of the sides of the containers 6, the portion 28*b* being slightly recessed in relation to the main sides of the containers 6, and the outer faces of the outer cap 28*b* lying substantially in the extension of the outer faces of the main sides.

The assembly of such a dispensing device is effected in the way that will now be described. Having first filled the two bottles 1 with the required products which can for example be two different products, each one of the container parts 6 is closed by disposing on their necks 8 the sub-caps 9 whose dispensing tubes 2 are hermetically sealed by frangible end fittings 3. Once the two bottles 1 have been joined to each other near their tops, the cap 4 is fitted thereon with the flange 13 coming to be inserted between the sub-caps 9 and the sides of the containers 6, and with the tubes 2 and their frangible end fittings 3 accommodated in the sleeves 18 and the cut outs 17. The cap 5 is then positioned on the cap 4 with the annular protuberance 20 cooperating with the inner cut out of the complementary wall 19 for holding the cap 5 and the cap 4 axially in relation to each other, the frangible end fittings 3 being accommodated in the bushings 22.

Thus assembled, the device is ready for use. To open it, the user exerts a torque on the fins 27 of the cap 5. The bushings 22 serving as shoulders entraining the frangible end fittings 3 in their movements, the end fittings 3 sliding on the surface of the bottom 16 which is opposite the top 21. The tubes 2 are then opened and the user can, by holding the cap 5 in a position where the frangible end fittings 3 are not opposite the dispensing openings of the tubes 2, simultaneously dispense the products contained in the containers 6, for example by positioning the two bottles upside down and then pressing on the flexible portions of the sides of the containers 6. The two products contained in each of the two bottles 1 both flow into the chamber 24 where they are mixed and are then evacuated through the dispensing duct 23 of the cap 5.

A dispensing device in accordance with a second embodiment of the invention has been represented in FIGS. 6 to 9, for which the same reference number system, but increased by 100, has been used for the elements of this device, that are also found in the first described embodiment of the device.

Such a device comprises in the same way as above, two bottles 101 which each comprise a container part 106 ending in a neck surmounted by a sub-cap extended in a dispensing tube 102 closed before use by a frangible end fitting 103. These tubes 102 and their frangible end fittings 103 pass through the bottom 116 of a cap 104 fitted on the capsules and whereon there is fitted a cap 105 whereof an internal cylindrical wall 126 cooperates with an internal wall 125 of the cap 104. The frangible end fittings 103 are fitted in bushings, one bearing the reference numeral 150, the other 151, these two bushings extending downwardly from the top of the cap 105. The bushing 150 is a cylindrical bushing whose internal shape substantially corresponds to the outer shape of the associated frangible end fitting 103. The bushing 151 has an oblong shape whose central portion is opposed substantially diametrically to the bushing 150, the frangible end fitting 103 associated with the said bushing 151 being capable of sliding in the bushing 151 before coming to bear on its ends which serve as a shoulder.

The assembly of such a device is substantially the same as that of the first embodiment of the invention described above. Once assembled, such a device is used in a way that will now be described. When the user exerts a torque on the fins 127 of the cap 105, he will first break the frangible end fitting 103 disposed in the bushing 150. Once broken, this end fitting 103 will be entrained by the bushing 150 by sliding on the bottom 116, whilst the other frangible end fitting 103 will remain in position on the dispensing opening of the tube 102 wherewith it is associated, the bushing 151 wherein it is disposed, sliding relative to the end fitting 103 without coming to bear on its walls. Subsequently, the inner sides of the bushing 151 will come to bear on the frangible end fitting 103 mounted in the bushing 151, so as to entrain and break the end fitting 103 in order to release the opening of the tube 102 whereon it has been mounted.

This second embodiment thus has the advantage that it allows the two dispensing tubes to be opened at two different instants, the user only having to exert a smaller torque on the cap 105 than if he had to break the two self breaking end fittings 103 simultaneously. Moreover, this also makes it possible to release the product contained in only one of the two bottles before the other, so as to treat the application surface at first only with a single product.

Figure 10:
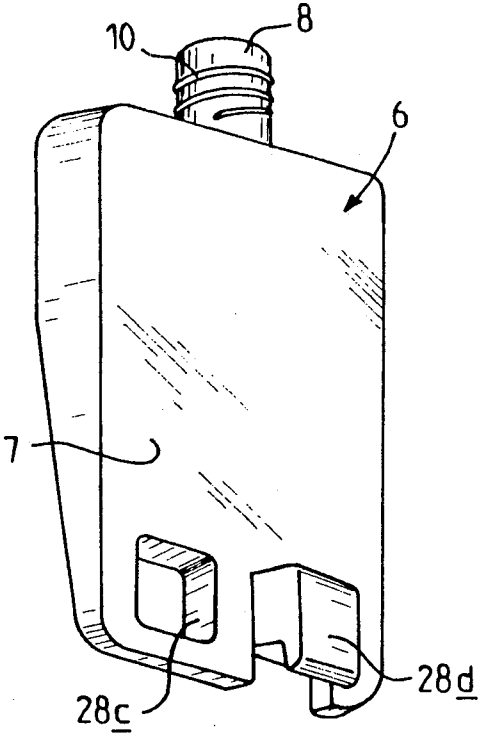
FIG. 10 is a perspective view of the part of the container of a bottle of a dispensing device corresponding to a second fixing variant.
Figure 4:
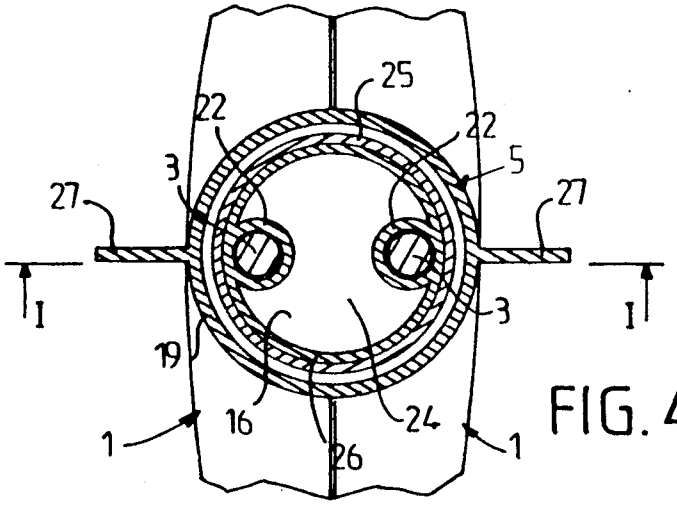
FIG. 4 is a partly sectioned view along section line IV—IV of FIG. 1.
Figure 5:
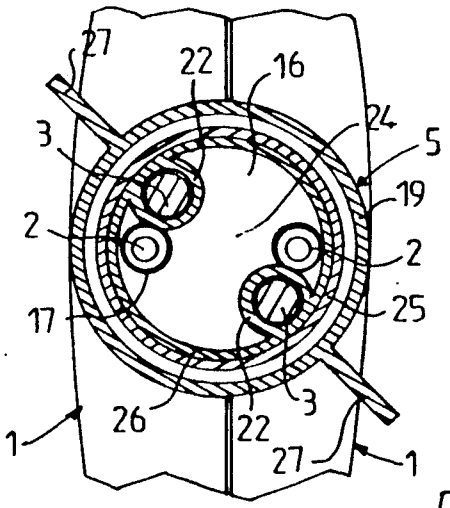
FIG. 5 is a partly sectioned view, similar to FIG. 4, of the dispensing device of FIG. 1 represented in an open position.
Figure 6:
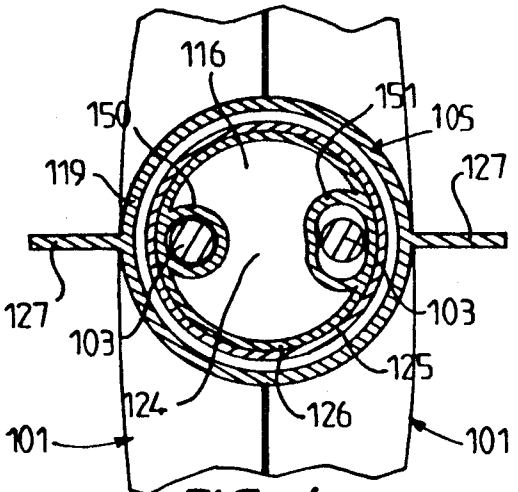
FIGS. 6 to 8 are partly sectioned views, similar to FIGS. 4 and 5, of a dispensing device in accordance with a second embodiment of the invention represented respectively in three different positions.
Figure 7:
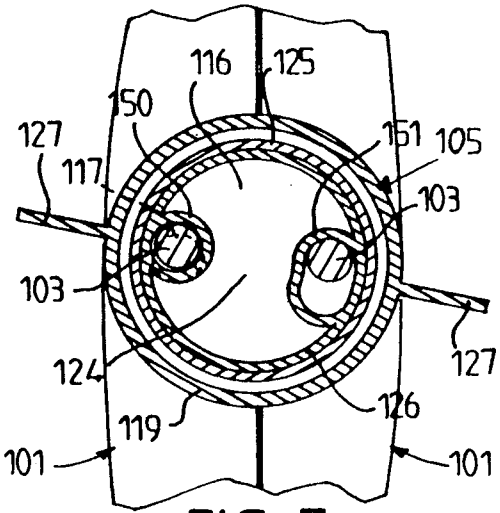
Figure 8:
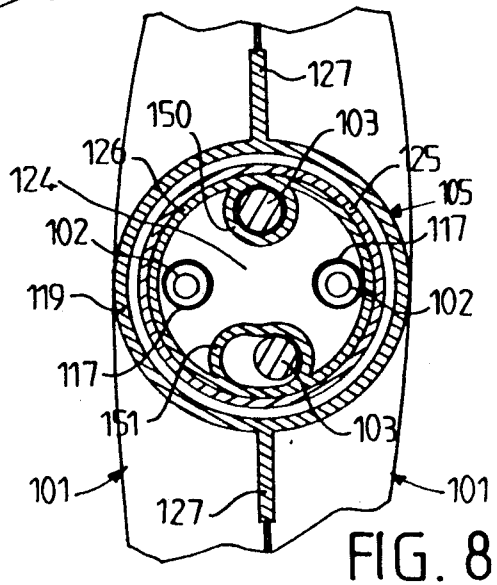
Figure 11:
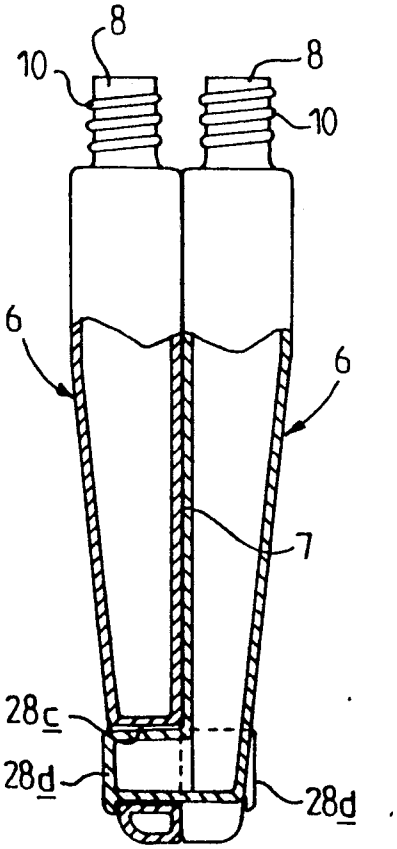
FIG. 11 is a sectional view of two container parts of the bottle of FIG. 10 joined to each other.
Figure 9:
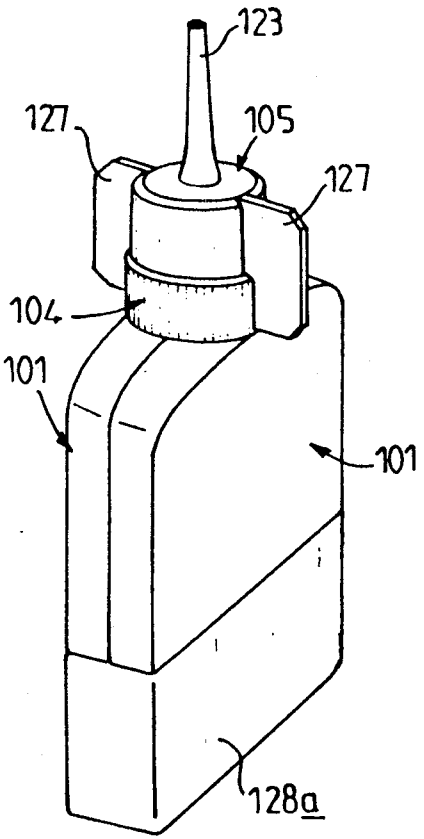
FIG. 9 is a perspective view of the device of FIGS. 6 to 8.

A possible variant of the fixing of the bottles has been illustrated in FIGS. 10 and 11. In this variant, the bottles are joined to each other, on the one hand, towards their dispensing ends by the cap 4 and, on the other hand, on the side towards their bottom by means of hooks 28*d* extending perpendicularly on the side 7 of the container 6 and cooperating with openings 28*c* traversing the thickness of the containers. Each container 6 comprises, distributed symmetrically in relation to the plane of symmetry of the containers 6 extending perpendicular to their side 7, on the one hand, a hole 28*c* and, on the other hand, a hook 28*d*.

Figure 13:
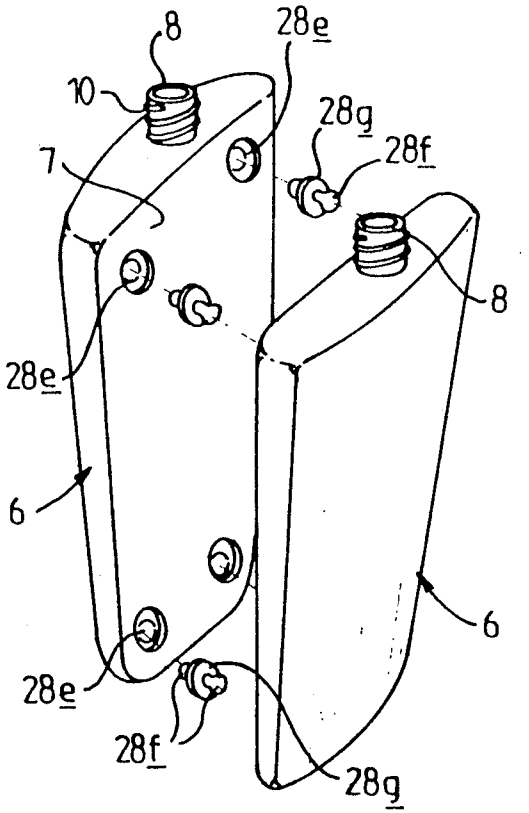
FIG. 13 is a view in an exploded perspective of two container parts of bottles intended to be joined to each other according to a third fixing variant.
Figure 12:
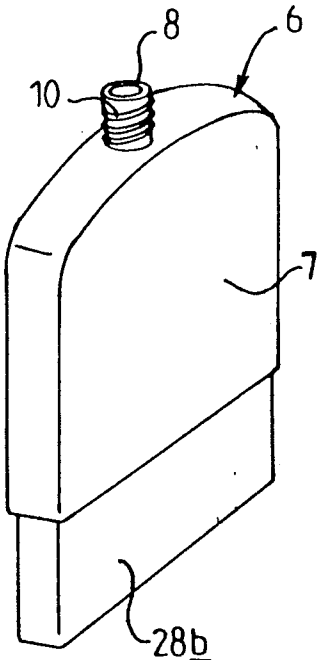
FIG. 12 is a view in perspective of a container part corresponding to a first fixing variant.

Another possible variant of the fixing of the containers 6 has been illustrated in FIG. 13. In this variant, the containers 6 are joined by four press studs 28*g* intended to cooperate as regards each side 7 with four female elements 28*e* distributed towards the four corners of the sides. Each press stud comprises a support which is a disc, and each of the two faces of this support is provided with a bead 28*f* serving as the male element. As for the female elements 28*e*, they are spherical portions arranged in the sides 7 and provided with flanges, these spherical portions being intended to receive and to retain the beads 28*f*.

I claim:

1. A dispensing device comprising:

(a) at least one bottle having a bottom and a side, said bottle having an end opposite from said bottom, said end being provided with a dispensing opening closed by a frangible end fitting; the improvement wherein (b) said device comprises a cap fitted on said end of said bottle adjacent said dispensing opening, said cap being movable relative to said bottle;

(c) said cap comprises at least one shoudler to engage said frangible end fitting as the cap is moved so as to displace said frangible end fitting to open the dispensing opening;

(d) said cap also comprises a discharge passageway issuing outside said dispensing device and communicating with said dispensing opening of said bottle when said frangible end fitting is displaced from said dispensing opening;

said cap including a bushing with said shoulder of said cap being a side of said bushing which extends within the cap and substantially surrounds the frangible end fitting associated therewith, said bushing having an internal surface substantially conforming to the external shape of the said frangible end fitting associated therewith, and another bottle is joined to said at least one bottle, said another bottle having a dispensing opening closed by another frangible end fitting; said cap including another bushing with said shoulder of said cap being a side of said another bushing, one of said bushings for one of said bottles closely conforming to the outer shape of said respective end fitting and the other of said bushings associated with the other of said bottles having an oblong cross section.

2. A device according to claim 1, wherein the cap is movable in rotation in relation to said bottles on which it if fitted, the dispensing opening of said bottles and the frangible end fittings associated therewith being located eccentrically relative to the axis of rotation of the said cap.

3. A device according to claim 1, wherein said device comprises a supporting wall having at one surface said frangible end fittings which are caused to slide by the shoulder of the cap associated therewith, said surface being disposed near the dispensing opening associated with each said frangible end fitting substantially in the same plane as said frangible end fittings.

4. A device according to claim 1, wherein the bottles are flexible and are deformed under the manual action of a user.

5. A device as claimed in claim 1, wherein said cap includes an outer wall having a cylindrical shape and which engages a sleeve element carried by said end of said bottles, said sleeve element serving to guide said cap during the rotational motion of said cap.

6. A device according to claim 1, wherein said bottles each include a sub-cap cooperating with the neck of the respective bottle with each said sub-cap extending with an outlet tube closed by said respective frangible end fitting.

7. A device as claimed in claim 6 further including a supporting wall having a surface surrounding said frangible end fittings of each said bottle, said surface being disposed near said dispensing opening associated with each said frangible end fitting and substantially in the same plane as the said frangible end fittings.

* * * * *